United States Patent [19]

Ingham

[11] 4,171,039

[45] Oct. 16, 1979

[54] COIN OPERATED LOTION DISPENSING APPARATUS

[76] Inventor: Steve F. Ingham, 2049 Alsup, Union Lake, Mich. 48085

[21] Appl. No.: 842,272

[22] Filed: Oct. 14, 1977

[51] Int. Cl.[2] ..... G07F 5/12

[52] U.S. Cl. ..... 194/9 T

[58] Field of Search ..... 222/193, 3, 2, 70; 194/9 T, 13; 239/426, 413

[56] References Cited

U.S. PATENT DOCUMENTS

| | | | |
|---|---|---|---|
| 617,245 | 1/1899 | Franklin | 239/426 X |
| 1,326,483 | 12/1919 | Doran | 239/426 X |
| 3,208,574 | 2/1964 | Anson | 194/3 |
| 3,240,398 | 3/1964 | Dalton, Jr. | 222/193 |
| 3,387,692 | 6/1968 | Levake | 194/13 X |

*Primary Examiner*—Stanley H. Tollberg

*Attorney, Agent, or Firm*—Barnes, Kisselle, Raisch and Choate

[57] ABSTRACT

Coin-operated apparatus for dispensing suntan lotion or the like comprising a selectively actuatable air compressor which directs an air stream through a first nozzle opening in a spray head across a second nozzle opening to aspirate lotion through the latter and atomize such lotion into a fine spray mist. The spray head is connected to the compressor and to a lotion tank by respective extensible flexible hoses such that the head may be moved over the exposed portions of a user's body to deposit a film of lotion thereof. A time delay relay turns off the compressor after a preselected adjustable dispensing period.

7 Claims, 9 Drawing Figures

FIG. 2
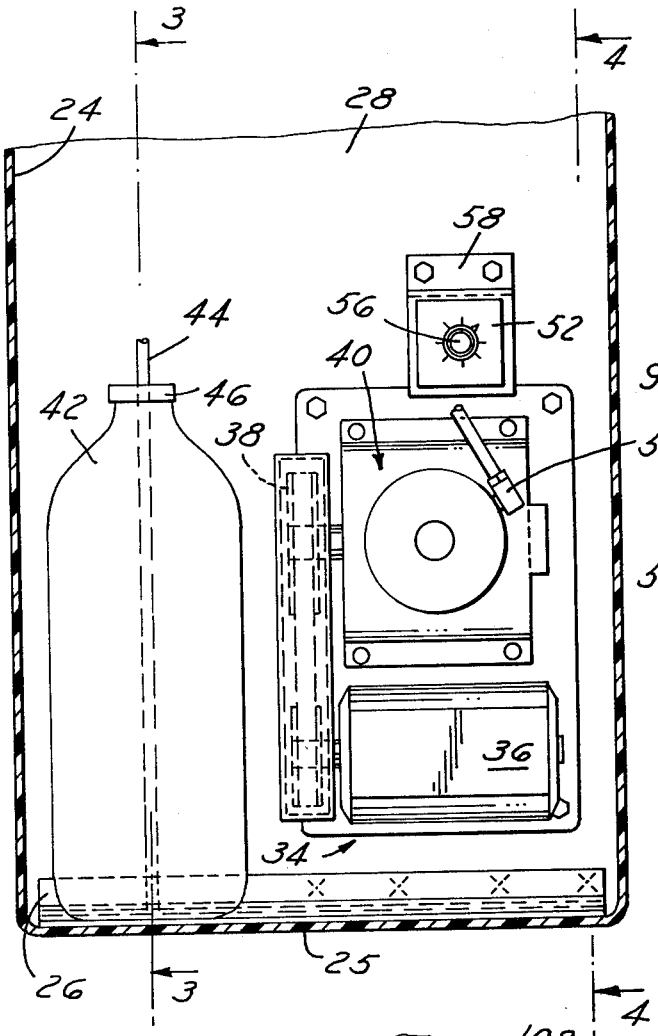
FIG. 4
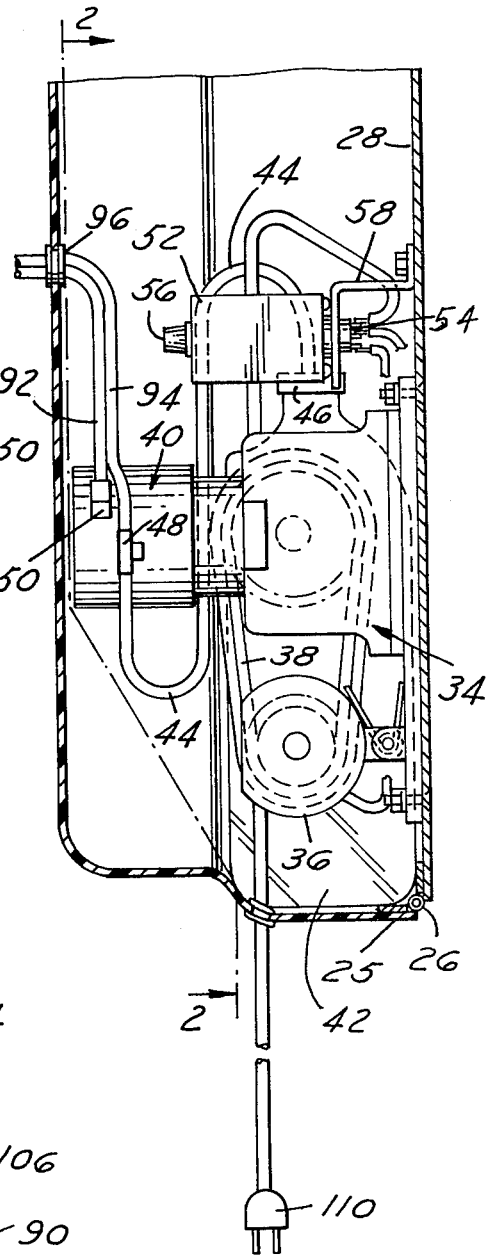
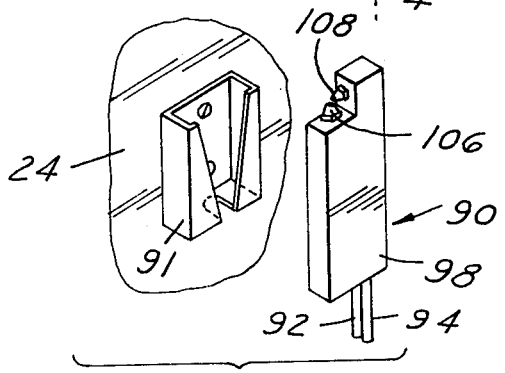
FIG. 7

COIN OPERATED LOTION DISPENSING APPARATUS

The present invention relates to liquid dispensing apparatus, and more particularly coin-operated apparatus for dispensing discrete quantities of liquid such as suntain lotion or the like as a high-velocity spray mist.

Apparatus of the subject type are disclosed, for example, in the U.S. Pat. Nos. of Govin et al 3,321,107 and Holtzman et al 3,348,735. Prior art apparatus, including those disclosed in the noted patents, suffer from a number of deficiencies including the requirement for pressurized containers of the liquid to be dispensed, as well as overall mechanical complexity and unreliability.

A general object of the present invention is to provide an apparatus of the above-noted type which is simple and economical to manufacture yet reliable in operation. More specific objects of the present invention are to provide apparatus of the noted type in which the liquid container may be at atmospheric pressure and in which the amount of liquid dispensed during discrete dispensing periods is readily adjustable over a wide range.

The invention, together with additional objects, features and advantages thereof, will be best understood from the following description, the appended claims and the accompanying drawings in which:

FIG. 1 is an overall front elevational view of the apparatus provided by the invention mounted on a bathhouse wall or the like;

FIG. 2 is front sectional view taken along the line 2—2 in FIG. 4;

Figure 1:
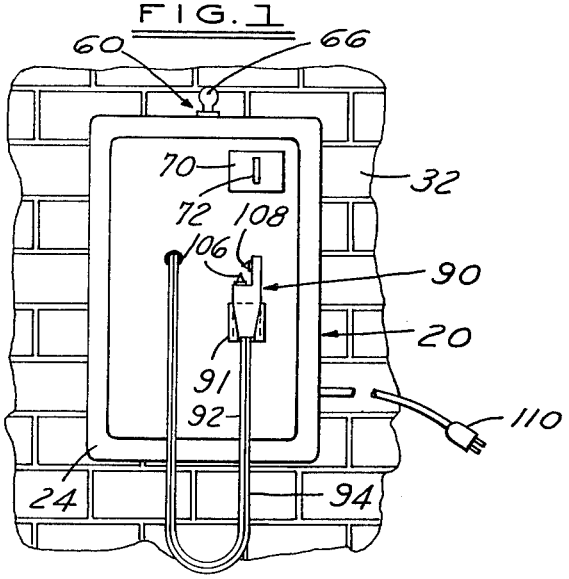
Figure 3:
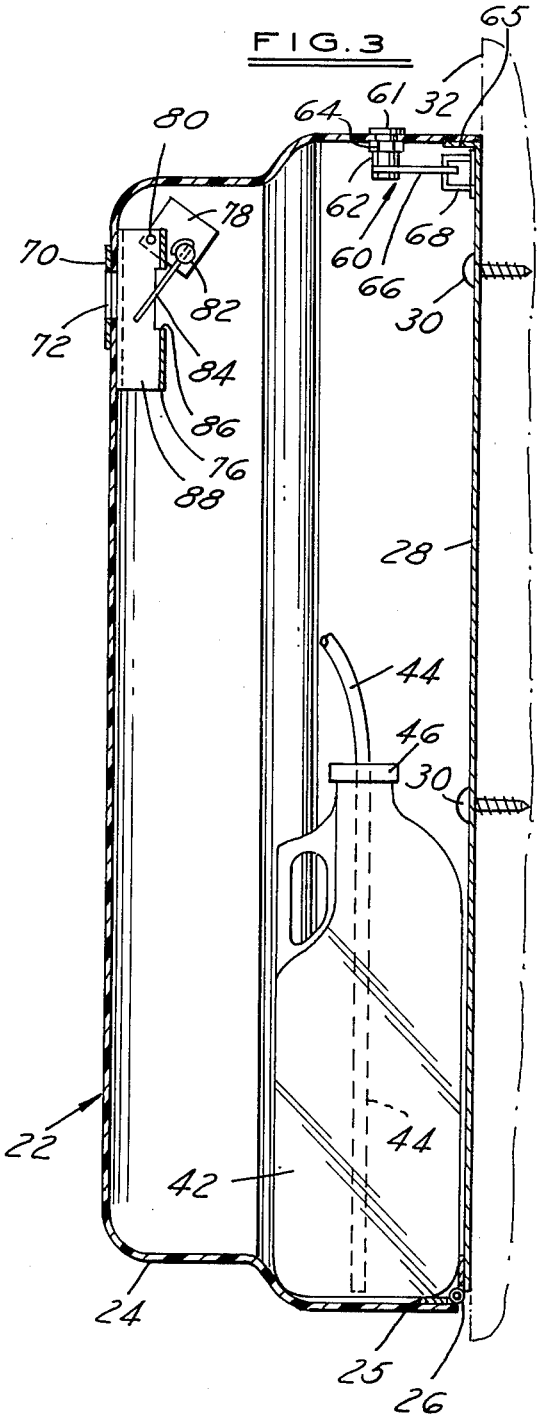
Figure 5:
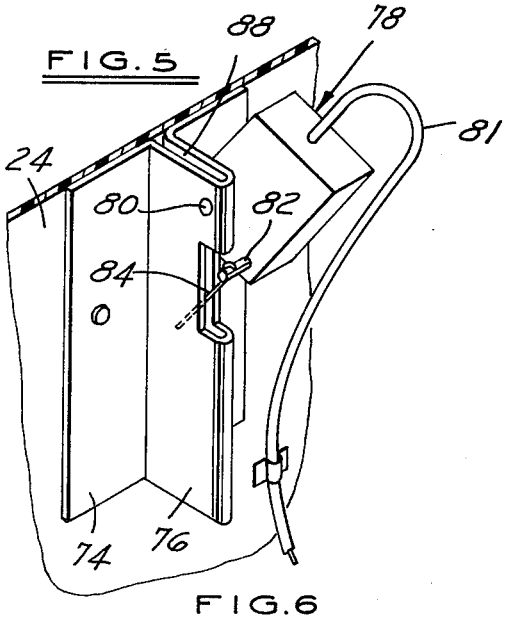
Figure 6:
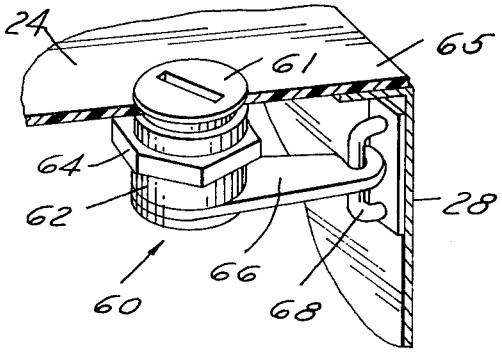
Figure 8:
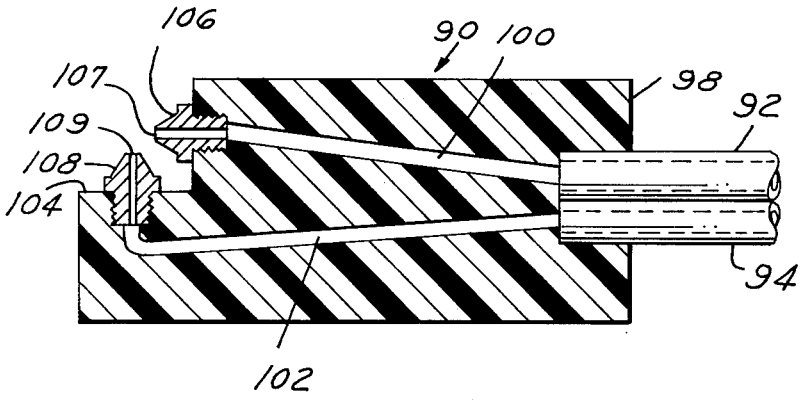
Figure 9:
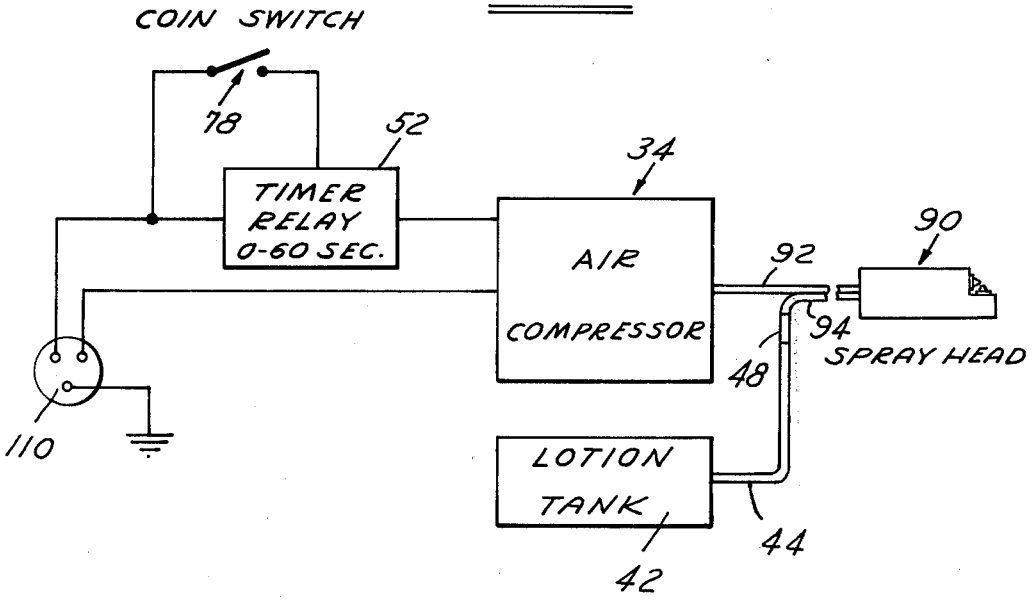

FIGS. 3 and 4 are side sectional views respectively taken along the lines 3—3 and 4—4 in FIG. 2;

FIGS. 5–7 are enlarged perspective views of portions of the apparatus as illustrated in FIGS. 1 and 3;

FIG. 8 is an enlarged sectional view of the spray head shown in FIGS. 1 and 7; and FIG. 9 is a schematic drawing of the apparatus components and is useful in understanding operation of the invention.

Referring to the drawings, particularly FIGS. 1–4, a presently preferred embodiment 20 of the dispensing apparatus provided by the invention comprises a housing 22 including a molded plastic cover 24 mounted along its lower edge 25 by a hinge 26 to a backing plate 28 which is adapted to be mounted by screws 30 in a substantially vertical plane to a bathhouse wall 32 or the like. An air compressor 34 is mounted on backing plate 28 and generally includes an electrical motor 36 connected by a drive belt 38 to an air pump generally indicated at 40. In a working embodiment of the invention, compressor 34, including motor 36 and pump 40, was purchased as a single unit designated the "Miller 2000" from the K. J. Miller Corporation of Broadview, Ill. Other small air compressors of the noted type are well known in the art and readily available.

A tank or bottle 42 for storing the liquid to be dispensed at atmospheric pressure is carried at the base of cover 22 adjacent edge 25 and may be removably secured in place by a suitable spring clip (not shown). A hose or conduit 46 extends from adjacent the bottom of bottle 42 through a vented bottle cap 46 to a coupling unit 48 mounted for convenience adjacent the air outlet 50 of pump 40. A time relay unit 52, such as a Potter & Brumfield No. CHB38-70013 adjustable time delay relay, is received in a suitable corresponding relay socket 54 and is electrically connected to motor 36 as will be described hereinafter. An knurled knob 56 (FIGS. 2 and 4) or the like is carried by relay 52 for adjusting the relay time delay, preferably over a range of at least zero to sixty seconds. Socket 54 is mounted by a suitable bracket 58 to backing plate 28.

A face plate 70 (FIGS. 1 and 3) is mounted externally of cover 24 and is provided with a vertically extending coin insertion slot 72. A bracket 47 (FIGS. 3 and 5) is mounted internally of cover 24 and includes an elongated thin vertically oriented channelled section 76 in registry with slot 72 for receiving and guiding coins inserted therethrough. As best seen in FIG. 3, channelled section 76 opens downwardly into the volume of housing 22 such that coins inserted through slot 72 full downwardly and collect in the lower portion of cover 24 adjacent bottle 42.

A switch 78 is mounted by screw 80 to channelled section 76 and has normally open switch contacts electrically connected by conductors 81 (FIG. 5) to relay 52 as will be described hereinafter. A pivotal actuator 82 extends laterally from switch 78 and has a wire finger 84 extending radially outwardly and downwardly therefrom through an aperture 86 in section 76 into the coin guide 88 provided thereby at about the level of coin slot 72. Thus, insertion of a coin through slot 72 depresses actuator finger 84 to pivot actuator 82 and close the contacts of switch 78. Slot 86 is of sufficient longitudinal dimension to accommodate downward pivotal movement of finger 84 and thereby permit the inserted coin to drop therepast. Spring bias on actuator 82 internally of switch 78 returns arm 84 to the position illustrated in FIG. 3 after passage of the coin.

Referring specifically to FIGS. 1, 3 and 6, a lock 60 is carried in the upper portion of housing 22 and comprises a slotted escutcheon plate 61 and a tumbler mechanism 62 extending therefrom and mounted as by nut 64 adjacent the upper edge 65 of cover 24. Tumbler mechanism 62 is pivotal about a generally vertical axis in response to insertion and turning of an appropriate key 66 (FIG. 1) through the escutcheon slot. A notched locking finger 66 extends radially from tumbler 62 and is pivotal conjointly therewith into and out of locking engagement with a keeper or eye 68 affixed to backing plate 28. Thus, lock 60 may be selectively released and cover 24 swung downwardly about hinge 26 to collect coins, to refill or replace bottle 42, or to service compressor 40.

A spray head 90 of size and shape adapted to be held in a user's hand is connected by separate extensible rubber hoses or conduits 92,94 through an opening 96 in cover 24 to air outlet 50 and lotion coupler 48 (FIG. 4). As best seen in FIG. 8, spray head 90 preferably comprises a generally rectangular block 98 of plastic material molded onto hoses 92,94 and having respective internal channels 100,102 extending longitudinally and separately therefrom. A generally square recess 104 is provided at a corner of block 98 remote from hoses 92,94, and the nozzle elements 106,108 having generally conical outer contours are threadably received in mutally orthogonal surfaces of recess 104 in respective communication with channels 100,102. The orifices of nozzles 106,108 are of generally uniform diameter and respectively open adjacent and at right angles to each other. Preferably nozzles 106,108 have opening or orifice diameters of 0.025 inches and 0.021 (preferred) to 0.048 inches respectively. Head 90 may be carried by a clip 91 on cover 24 during periods of non-use. Thus, a stream of compressed air is directed by the opening 107 of nozzle 106 past the opening 109 of nozzle 108 which results in a partial vacuum at nozzle 108 and thereby aspirates liquid from bottle 42 to the nozzle. Aspirated liquid emerging from nozzle 108 will be atomized by the compressed air stream to form a high velocity liquid spray mist.

FIG. 9 is a schematic diagram of apparatus 20 and illustrates the electrical plug 110 which hangs downwardly from cover 24 (FIG. 4) for insertion into a standard utility power outlet. When switch 78 is actuated by insertion of a coin, electrical power is fed by timer relay 52 to compressor 34 for a preset time period between zero and sixty seconds. Compressor 34 is then activated and a high velocity spray mist is provided by head 90 as hereinabove described. When apparatus 20 is utilized for dispensing suntan lotion, for example, head 90 may be moved over exposed portions of the user's body to deposit an even layer of lotion. When relay 52 times out, compressor 34 is deactivated pending subsequent insertion of a coin. Upon initial installation or after bottle 42 runs dry, apparatus 20 is "primed" by repeated activation of switch 78 until lotion appears at nozzle 108. Thereafter, lotion will remain in hoses 44,94 during periods of non-use (unless bottle 42 runs dry) so that the apparatus is always ready for use.

From the foregoing description it will be appreciated that the dispensing apparatus provided by the invention fully satisfies all of the objects and aims previously set forth. For example, provision of a compressed-air/aspirated-fluid dispensing arrangement eliminates the need for pressurized fluid containers and thereby reduces both the cost of operation and the danger of explosion. Similarly, the compressed air system eliminates the requirement for potentially hazardous chemical fluid propellants. The use of an adjustable timer relay greatly simplifies the dispensing control arrangement while at the same time both providing reliability and facilitating readjustment. Extensible hoses 92,94 may be quite long for the convenience of a user and may be inserted through hole 96 and stored internally of housing 22 during periods of non-use.

Although the invention has been described in connection with a specific embodiment thereof, alternatives, modifications and variations are contemplated. For example, it will be appreciated that the term "coin" as used herein contemplates both currency and pre-purchased special coin-like tokens or the like. Similarly, timer relay 52 may comprise an electromagnetic time delay relay as disclosed or a suitable solid-state equivalent. Hence, the invention is intended to embrace the above-noted and all other alternatives and modifications as fall within the spirit and broad scope of the appended claims.

The invention claimed is:

1. Apparatus for selectively dispensing a quantity of liquid such as suntan lotion or the like comprising tank means adapted for storage of a liquid to be dispensed at substantially atmospheric pressure, air compressor means adapted to be electrically powered, means providing a slot in said apparatus adapted to receive a coin, switch means including a first switch responsive to insertion of a coin into said slot by an apparatus user to connect electrical power to said compressor means for only a preselected time period, a housing including mounting means adapted to mount said apparatus on a building wall or the like and cover means pivotally carried by said mounting means and adapted to be pivoted away from said mounting means to expose said compressor means, said switch means and said tank means carried within said housing, spray head means adapted to be held in the hand of an apparatus user, and elongated flexible conduit means connecting said spray head means separately to said tank means and said compressor means, said spray head means including first nozzle means connected by said conduit means to receive liquid to be dispensed at substantially atmospheric pressure and second nozzle means distinct from said first nozzle means connected by said conduit means to receive compressed air from said compressor means, said first and second nozzle means being oriented with respect to each other such that a compressed air stream from said second nozzle means is directed past said first nozzle means externally of said spray head means to both aspirate liquid from said tank means through said first nozzle means and atomize liquid aspirated from said first nozzle means to form a high-velocity liquid spray mist.

2. The apparatus set forth in claim 1 wherein said switch means further comprises time delay relay means responsive to said first switch to connect said power to said compressor means for only said preselected time period.

3. The apparatus set forth in claim 2 wherein said time delay relay means is adjustable to provide a said preselected time period in at least the range of zero to sixty seconds.

4. The apparatus set forth in claim 1 wherein said slot means is disposed on said cover means, and wherein said first switch means comprises mechanical switch means having an actuator arm extending into said slot means to detect insertion of a coin.

5. The apparatus set forth in claim 4 further comprising means providing an aperture in said cover means through which said conduit means is extensible.

6. The apparatus set forth in claim 1 wherein said first and said second nozzle means include respective nozzle openings disposed in said spray head means at right angles to each other.

7. The apparatus set forth in claim 6 wherein first nozzle means has an opening diameter of 0.025 inches and said second nozzle means has an opening diameter in the range of 0.021 to 0.048 inches.

* * * * *